US005657026A

United States Patent [19]

Culpepper et al.

[11] Patent Number: 5,657,026

[45] Date of Patent: Aug. 12, 1997

[54] BEACON SIGNAL RECEIVING SYSTEM

[75] Inventors: Jerry W. Culpepper, Garland; John D. Markus, Plano; Lawrence M. Smith, Lewisville; Zhaoliang Chen, Dallas, all of Tex.

[73] Assignee: Electronic Tracking Systems, Inc., Dallas, Tex.

[21] Appl. No.: 592,809

[22] Filed: Jan. 26, 1996

[51] Int. Cl.[6] ..... H01Q 3/02

[52] U.S. Cl. ..... 342/374; 342/101; 342/386; 342/418

[58] Field of Search ..... 342/101, 374, 342/385, 386, 45, 418

[56] References Cited

U.S. PATENT DOCUMENTS

| | | | |
|---|---|---|---|
| 4,001,828 | 1/1977 | Culpepper | 343/113 |
| 4,021,807 | 5/1977 | Culpepper et al. | 343/112 |
| 4,023,176 | 5/1977 | Currie et al. | 343/113 |
| 4,743,908 | 5/1988 | Brassfield et al. | 342/113 |
| 4,764,769 | 8/1988 | Hayworth et al. | 342/50 |
| 5,134,719 | 7/1992 | Mankovitz | 455/154.1 |
| 5,146,231 | 9/1992 | Ghaem et al. | 342/419 |
| 5,239,701 | 8/1993 | Ishii | 455/180.1 |
| 5,402,129 | 3/1995 | Gellner et al. | 342/70 |

*Primary Examiner*—Thomas H. Tarcza
*Assistant Examiner*—Dao L. Phan
*Attorney, Agent, or Firm*—Vinson & Elkins L.L.P.

[57] ABSTRACT

A method and apparatus for locating and tracking a portable transmitter that may be deposited with currency or other items desired to be tracked, comprising a doppler antenna array, analog antenna switching, radio frequency and intermediate frequency circuitry and a digital signal processor, exhibiting increasing sensitivity, accuracy, and range.

26 Claims, 7 Drawing Sheets

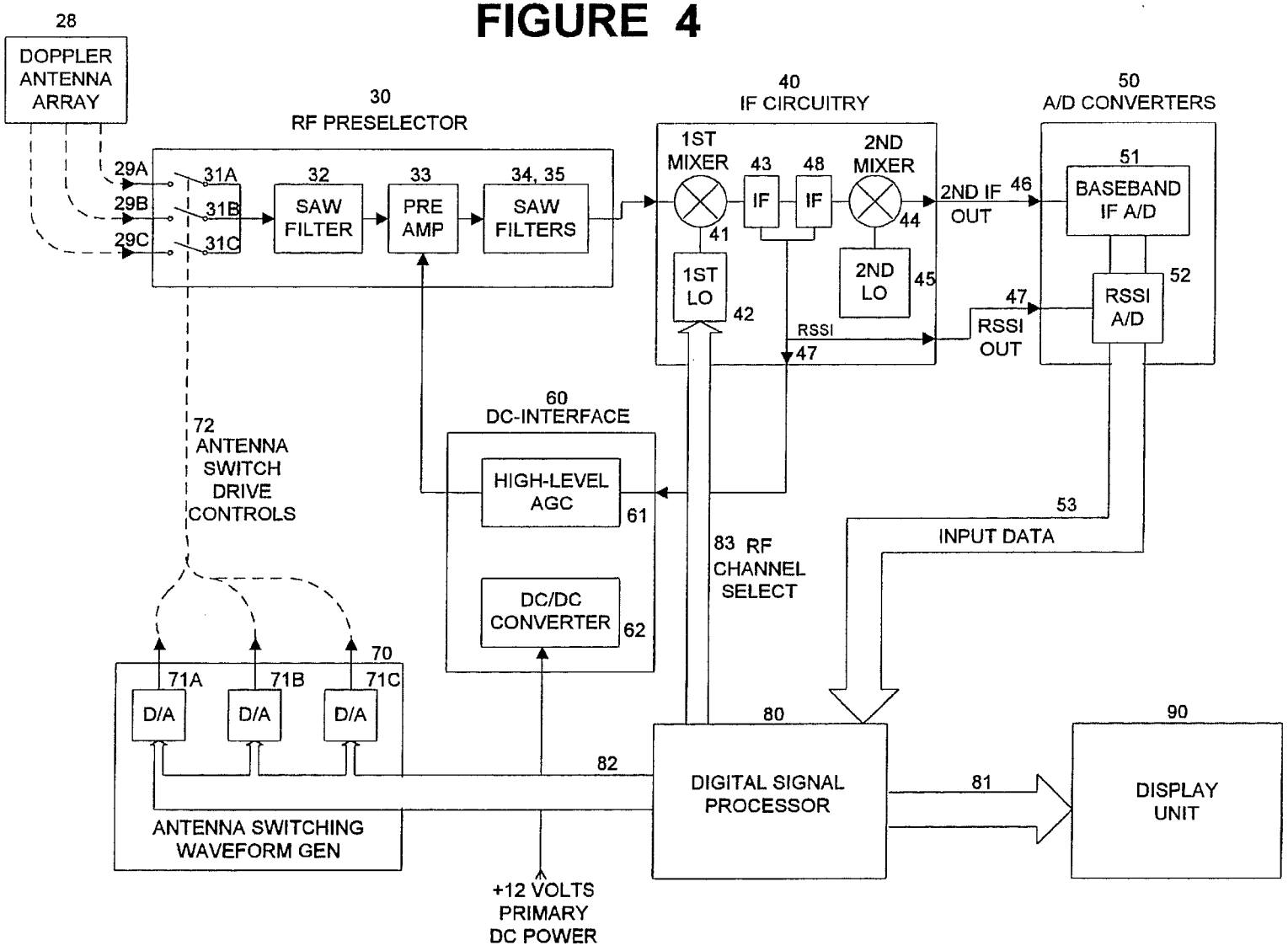
FIGURE 4
28
DOPPLER ANTENNA ARRAY
29A
29B
29C
30
RF PRESELECTOR
31A
31B
31C
32
SAW FILTER
33
PRE AMP
34, 35
SAW FILTERS
40
IF CIRCUITRY
1ST MIXER
41
1ST LO
42
43
IF
48
IF
2ND MIXER
44
2ND LO
45
RSSI
47
2ND IF OUT
46
RSSI OUT
47
50
A/D CONVERTERS
51
BASEBAND IF A/D
52
RSSI A/D
53
INPUT DATA
60
DC-INTERFACE
HIGH-LEVEL AGC
61
DC/DC CONVERTER
62
83 RF CHANNEL SELECT
80
DIGITAL SIGNAL PROCESSOR
81
82
90
DISPLAY UNIT
+12 VOLTS PRIMARY DC POWER
70
71A
71B
71C
D/A
D/A
D/A
ANTENNA SWITCHING WAVEFORM GEN
72
ANTENNA SWITCH DRIVE CONTROLS

BEACON SIGNAL RECEIVING SYSTEM

BACKGROUND OF THE INVENTION

1. Field of the Invention

The present invention relates generally to a system for monitoring a beacon signal, and more specifically to an improved receiver for identifying and tracking a signal generated by a portable transmitter. If the transmitter is placed with currency or other valuables, the invention can be used to facilitate the location and pursuit of the transmitter and apprehend a would-be thief. While the invention will be illustrated by a system for the apprehension of the perpetrators of a theft, other applications of the invention will immediately suggest themselves, including the location and tracking of persons, vehicles and other portable objects.

2. Description of the Art

As stated above, the present invention may be used to facilitate and improve the deterrence of crime and the apprehension of criminals. A radio frequency transmitter is initially secreted in a packet of currency or other valuables. The packet may comprise a packet of real currency which has been modified so as to provide an interior recess wherein is located the transmitter. Alternatively, the packet may comprise simulated currency similarly configured so as to provide an internal recess for the transmitter. In other cases it may be preferable to combine real currency with simulated currency to make up the packet.

The battery powered transmitter may be energized through a switch which is in a normally open state when the currency packet is located in the currency drawer or other storage compartment. The act of removing the currency packet from the storage location causes this switch to close, thereby energizing the transmitter to transmit at a predetermined radio frequency.

Receivers for monitoring and tracking a portable transmitter have long been known in the prior art. Prior methods used for tracking a portable transmitter have used a dual channel radio frequency (RF) receiver with a two antenna system used as an interferometer to measure the phase difference of the received signal to determine the angle of arrival of the signal. FIG. 1 shows such a prior art system. Antennas 1A and 1B received transmitted data, which is input into RF circuitries 2 and 3. The information is processed and input into IF circuitries 4 and 5. The outputs of IF circuitries 4 and 5 are used by angle detector circuitry 6, which uses phase differences to determine the angle between the transmitter and receiver. This data is output as direction information 8A. Signal detector circuitry identifies the transmitting signal and generates signal alert information 8C. Signal level information 8B is also generated by IF circuitry 5. This angle information could then be used to determine the direction from the receiver to the transmitting signal. Examples of such prior art are shown in U.S. Pat. Nos. 4,021,807, 4,001,828 and 4,023,176, which are incorporated herein by reference.

While useful, this prior art system has several major disadvantages. In particular, the system shown in FIG. 1 only provides unambiguous direction information for an are of 180 degrees. Thus, the system requires manual operation to switch to a rear antenna 1C to determine if the signal is in front or rear of the receiver. Moreover, the system shown in FIG. 1 requires two complete RF receiver channels. In addition, the system requires high dynamic-range phase tracking within the narrow intermediate frequency (IF) bandwidth, leading to increased noise and error.

An improvement on this system is shown in FIG. 2. FIG. 2 shows a single RF channel receiver which can process the information from an electronically scanned, three-element antenna array. Information from antennas 10A, 10B, and 10C is selected by antenna switching circuitry 11. This information is then processed by RF circuitry 12 and IF circuitry 13. FM detector circuitry 14 provides input to the angle detector circuitry 15, which outputs direction information. Antenna waveform generator circuitry 18 provides a waveform to antenna switching circuitry 11. AM detector circuitry receives the output from IF circuitry 13 and provides signal level information 19B and signal alert information 19C. Automatic gain control 17 is coupled to the RF circuitry 12. A receiver design which uses the method of operation shown in FIG. 2 is now being used by ProNet, Inc. The direction information 19A is provided by a frequency modulation (FM) demodulator which provides the detected antenna modulation that is then compared to the reference signal used to generate the antenna switching. The phase difference in this comparison is proportional to the angle of arrival of the signal.

This system has several advantages over the system shown in FIG. 1. For example, the system requires only one RF receiver channel. In addition, the system shown in FIG. 2 does not require high dynamic range phase tracking of two RF channels. Also, the newer system provides an unambiguous 360 degree continuous direction measurement.

The system shown in FIG. 2, however, has several disadvantages. In particular, the antenna switching circuitry 11 results in a spectrum spreading of the input signal based on the waveforms used in the antenna switching from antenna generating circuitry 18. The system shown in FIG. 2 uses a square pulse antenna switch control signal, resulting in a sin(x)/x spectrum that causes out-of-band signals to be folded into the operating band. This results in out-of-band signal energy being folded into the band of operation and causes interference. Another disadvantage of the system shown in FIG. 2 is that it uses a wide band phase-locked loop (PLL) demodulator to detect the antenna modulation, resulting in low sensitivity to and capture of signals in the IF band of the receiver. A wide bandwidth is thus required to allow for the frequency uncertainty of the signal.

Other disadvantages of the system shown in FIG. 2 include the following:

- the angle detector circuitry 15 uses a set/reset pulse phase comparator to measure the antenna phase angle, resulting in a higher signal-to-noise ratio required for a given phase measurement accuracy;
- the AM detector circuitry 16 uses noncoherent amplitude modulation (AM) detection to detect the transmitter signal. This results in a higher required signal-to-noise than would a coherent AM detector;
- the system requires a slow responding automatic gain control (AGC) 17 to operate over the dynamic range of operation for AM detection. This causes intermittent bursts of inference to capture the AGC; and
- the system uses a single 90 Hz tone modulation to activate the signal alert information. This is subject to false alarms in identifying the transmitter signal due to many types of electromagnetic interference (EMI) and interfering signals which appear to have the 90 Hz modulation.

It is therefore an object of the present invention to reduce spectrum-spreading and resulting interference in the receiver.

It is a further object of the present invention to increase the sensitivity of the receiver to RF signals.

It is yet a further object of the present invention to decrease the signal-to-noise ratio required for a given phase measurement accuracy in a receiver.

It is a further object of the present invention to decrease the reliance on AGC in the receiver.

It is yet a further object of the present invention to reduce the number of false alarms in identifying the transmitter signal.

It is a further object of the present invention to increase the operating range of the receiver.

Other objects of the invention are apparent from the summary, drawings and detailed description below.

SUMMARY OF INVENTION

The invention is an improved beacon tracking receiver which may be adapted for installation either in police vehicles or in fixed police installations. The beacon tracking receiver comprises a receiver section and a display section. In the preferred embodiment, the receiver section employs three antennas which, in one application, may be mounted on the roof of a police cruiser. The receiver senses the phase difference between the signals picked up by the antennas and utilizes this information to determine where the transmitter is in reference to the police vehicle.

This directional information is visually displayed by means of an LCD display with an electroluminenscent (EL) panel backlight, which comprises a portion of the display unit. In the mobile vehicle application, this display unit is conveniently adapted to be mounted on the dash of the police vehicle. The display system includes a second panel meter which responds to the RF signals detected by the receiver to indicate the relative distance of the transmitter. An audible tone signal is also provided to indicate to the vehicle operator when a transmitter signal is being detected. The frequency of this signal is variable and indicative of the relative power of the transmitter signal. The combination audible/visual display allows the driver to minimize eye contact with the display unit and to track by ear so as not to interfere with his operation of the vehicle. Since the intended use of the invention is primarily automotive, the receiver must operate on a nominal 12 volt DC power supply and be compact and rugged.

The new receiver 27, shown in FIG. 3, is designed to address the disadvantages of the previous systems. Signals from three low loss, low side lobe level doppler scan antennas 20A, 20B, and 20C are controlled with Gaussian wave forms by an analog switch control 72 which is coupled to antenna waveform generator 70 (FIG. 4). The outputs of the switches 31A, 31B and 31C (FIG. 4), controlled by analog switch control 72, are coupled to a radio-frequency (RF) preselector 30. The signals are then processed by intermediate frequency (IF) circuitry 40 and output to a DSP 80. The DSP 80 then outputs direction 26A, signal level 26B and signal alert information 26C, as well as feedback to the analog switch control 72.

Several advantages are apparent over the prior art. The doppler antenna array 28 provides a more narrow signal band. The analog switch control 72 minimizes spectrum spreading. The receiver 27 operates over a high dynamic range, and incorporates an instantaneous hard-limiting AM/FM receiver, so that AGC is not required. The receiver 27 incorporates a PPL coherent AM detector, replacing the incoherent detection used in prior art systems. The use of DSP 80 for signal processing permits a rapid signal search and lock algorithms and digital IF filter tuning. Receiver 27 shows increases in both range and sensitivity over the prior art.

Other advantages will become apparent from the detailed description of the embodiments.

BRIEF DESCRIPTION OF THE DRAWINGS

The features, objects and advantages of the present invention will become more apparent from the detailed description set forth below when taken in conjunction with the drawings in which like reference characters identify correspondingly throughout and wherein:

FIG. 4 illustrates a more detailed functional block diagram of the receiver;

DETAILED DESCRIPTION OF THE PREFERRED EMBODIMENT

Figure 1:
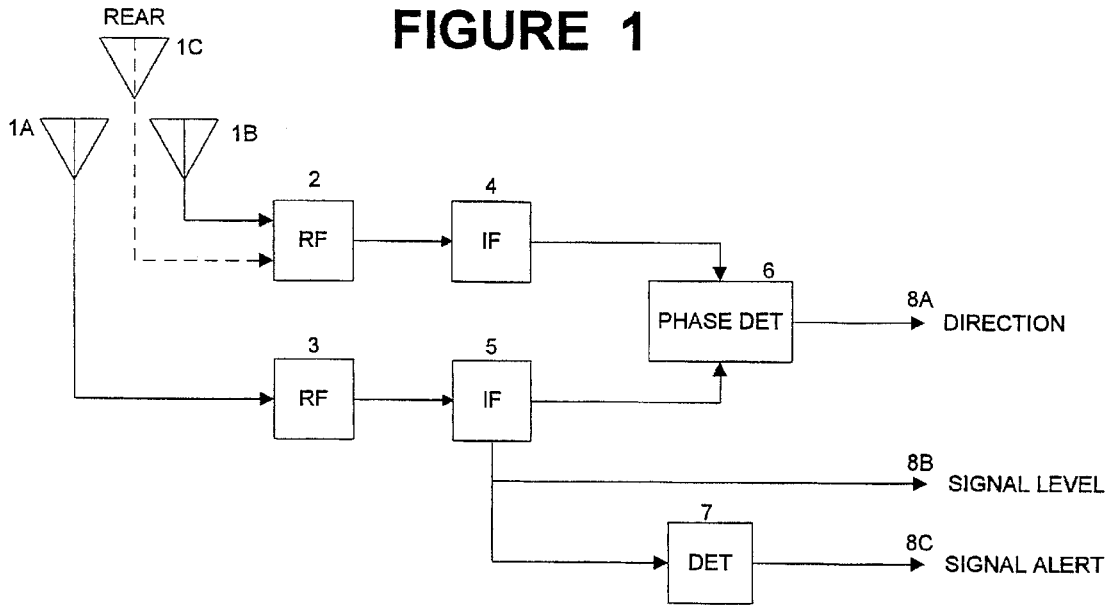
FIG. 1 is a block diagram of a prior art receiver system.
Figure 2:
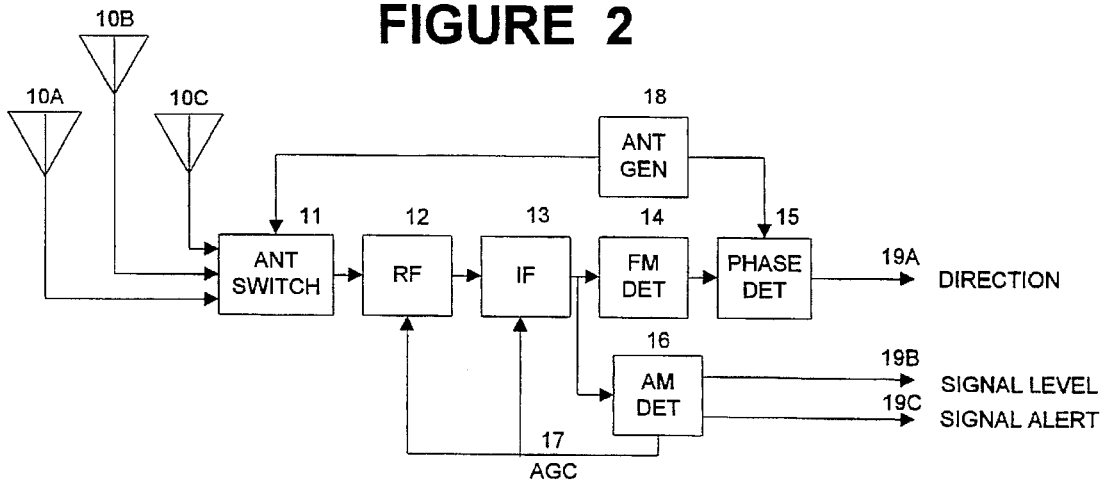
FIG. 2 is a block diagram of a more recent prior art receiver system, addressing some of the disadvantages of the system shown in FIG. 1.
Figure 3:
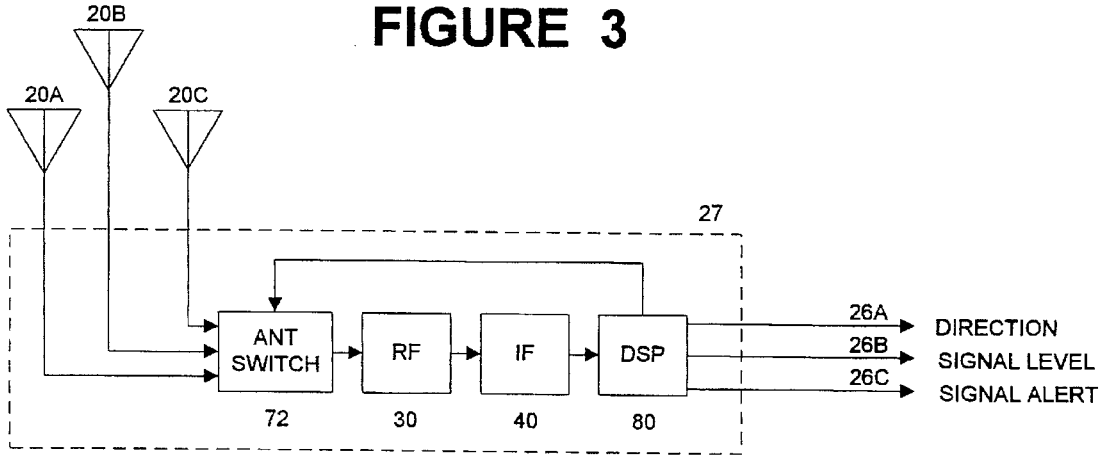
FIG. 3 is a functional block diagram of the new receiver.

While the following description relates the preferred embodiment of the invention, alternative embodiments will be apparent to a person familiar with the art.

FIG. 4 shows the receiver 27 in detail. In the preferred embodiment, the receiver 27 consists of a three-element doppler antenna array 28 comprising inputs from three separate low loss, low side lobe doppler scan antennas 29A, 29B, and 29C, which are multiplexed to the RF preselector 30 by RF analog switches 31A, 31B, and 31C. The RF analog switch control 72 signals are generated by the digital signal processor (DSP) 80 by means of digital-to-analog (D/A) converters 71A, 71B, and 71C. The switch control 72 signals are analog Gaussian-wave pulse signals produced by antenna waveform generator 70, and are used to reduce the sidelobe levels of the switching by 80 dB outside the 8 kHz bandwidth of the receiver 27.

The RF signal 36 is converted to a first IF frequency by 1st local oscillator (LO) 42 and input to 1st IF amplifier 43. The signal is then converted to 2nd IF output 46 by 2nd LO 45. The 8 kHz BW of the signal is then A/D converted and processed by the DSP 80. The DSP 80 performs the AM/FM demodulation, data detection, signal identification, and provides the information to the display unit 90 for the signal alert 26C, signal level 26B, code ID 26D and direction information 26A.

The RF preselector 30 portion of the receiver 27 contains three voltage-controlled RF analog switches 31A, 31B, and 31C, three SAW bandpass filters 32, 34, and 35, and a single low-noise broadband integrated circuit RF amplifier 33. Received signals from the three antennas in the external Doppler antenna array 28 are sequentially commutated into a single SAW bandpass filter 32 by the three voltage controlled RF analog/switches 31A, 31B, and 31C in accordance with waveforms generated by the antenna waveform generator 70. After filtering by the 1st SAW filter 32, the combined received signals are amplified by a low-noise integrated circuit amplifier 33 and then filtered by two cascaded SAW bandpass filters 34 and 35. The signals are then applied to IF circuitry. 40. At high signal levels, the receiver upper dynamic range is extended by decreasing the nominal preamplifier gain through a controlled reduction in the preamplifier DC supply voltage.

The IF circuitry 40 contains two active mixer integrated circuits 41 and 44, two IF amplifier integrated circuits 43 and 48, and two LO sources 42 and 45. Input signals from the RF preselector 30 are converted to an IF frequency of 10.7 MHz by the 1st mixer 41 using one of three selectable oven-controlled crystal oscillator LO frequencies. IF selectivity for signals from the 1st mixer 41 is obtained with narrow band crystal filters before, after, and between the two IF amplifier integrated circuits 43 and 48. Both of the IF amplifier integrated circuits 43 and 48 are cascade multiple-stage limiting type amplifiers, providing a combined gain of 100 dB and logarithmic received signal strength indicator (RSSI) outputs with a dynamic range in excess of 90 dB. The RSSI output 47 is the primary source for signal strength and amplitude demodulation on signals with high signal-to-noise ratios in the IF bandwidth. Hard limited IF signals from the second IF amplifier 48 in the IF chain are filtered before conversion by a second active-mixer-crystal oscillator 45 to the 2nd IF frequency of 10 KHZ for sampling by the DSP A/D converters 50.

The A/D converters 50 are responsible for converting the continuous-time 2nd IF output 46 and RSSI output 47 into discrete, time-quantized sample streams which can be operated upon by the DSP 80. Both baseband converter 51 and RSSI converter 52 must adequately sample their respective inputs 46 and 47; i.e., the Nyquist sampling criteria must be met. The inputs of both baseband converter 51 and RSSI converter 52 must be provided with bandwidth limiting for nonambiguous digital signal processing. Both baseband output 46 and RSSI output 47 should be frequency limited to less than half their respective sampling frequencies; this is accomplished by the receiver. The baseband sampling should be done at a faster rate and with greater resolution than the RSSI sampling.

The DSP 80 is composed of hardware which implements a computer optimized for signal processing functions; and a firmware program run on the former, which implements the specific signal processing algorithms. The hardware is further segregated so that many of the secondary functions (serial communications, status reporting, etc.) are assumed by a microcontroller 100; thus freeing the DSP 80 for signal processing functions. The DSP is discussed in greater detail in reference with FIG. 9.

The inputs 53 to the DSP 80 are composed of sample streams of baseband and RSSI data from the A/D convertors 51 and 52, and operator commands from either the display unit 90 or the serial I/O port 95 (not shown in FIG. 4). RF channel select output 83 from the DSP 80 is composed of three oscillator enable signals to the IF amplifier circuitry 40. Generator output 82 consists of three sample streams to the digital to analog convertors 71A, 71B and 71C, and display output 81 consists of periodically updated serial status data to either the display unit 90 or a host computer.

The firmware in the DSP 80 utilizes a Fast Fourier Transform (FFT) algorithm to provide speedy signal acquisition, and implements a tuneable narrow bandpass filter function to achieve improved RF selectivity and sensitivity. A phase-locked loop (PLL) demodulates relative direction information, and amplitude modulated signal validation information is recovered from either an audio tone filter/detector or from a correlator filter. As discussed, antenna commutation is also controlled by the DSP 80.

The D/A convertors 71A, 71B, and 71C, including associated reconstruction filtering, reconstitute the analog waveforms which are used to control the antenna switches 31A, 31B, and 31C. These D/A convertors 71A, 71B, and 71C are updated at the same sampling rate as the baseband A/D convertor, and output a waveform selected to minimize spectral folding effects caused by antenna commutation. An additional D/A convertor output is available to monitor selected signal streams within the DSP firmware; these are used for diagnostics as well as to output analog signals to other equipment.

The display unit 90 is implemented as a component separable from the remainder of the receiver. It communicates with the DSP 80 via an RS232 type serial data interface. A custom designed backlit Liquid Crystal Display (LCD) is utilized to present relative direction, signal strength, signal validation, and status information to the user in any lighting condition. A mutable, audible alert is provided whose frequency is proportional to received signal strength (RSSI). Additionally, the display can be used to alter selected calibrations within the receiver; thus facilitating both assembly testing and field setup.

The DC interface 60 is coupled to the RF preselector 39, the IF circuitry 40, and a 12 V DC power supply. The DC interface houses high-level AGC 61 which responds to the RSSI signal 47, as well as DC/DC converter 62 which converts the 12 V DC to ±5 V DC to power the DSP 80 and other circuitry.

Figure 5:
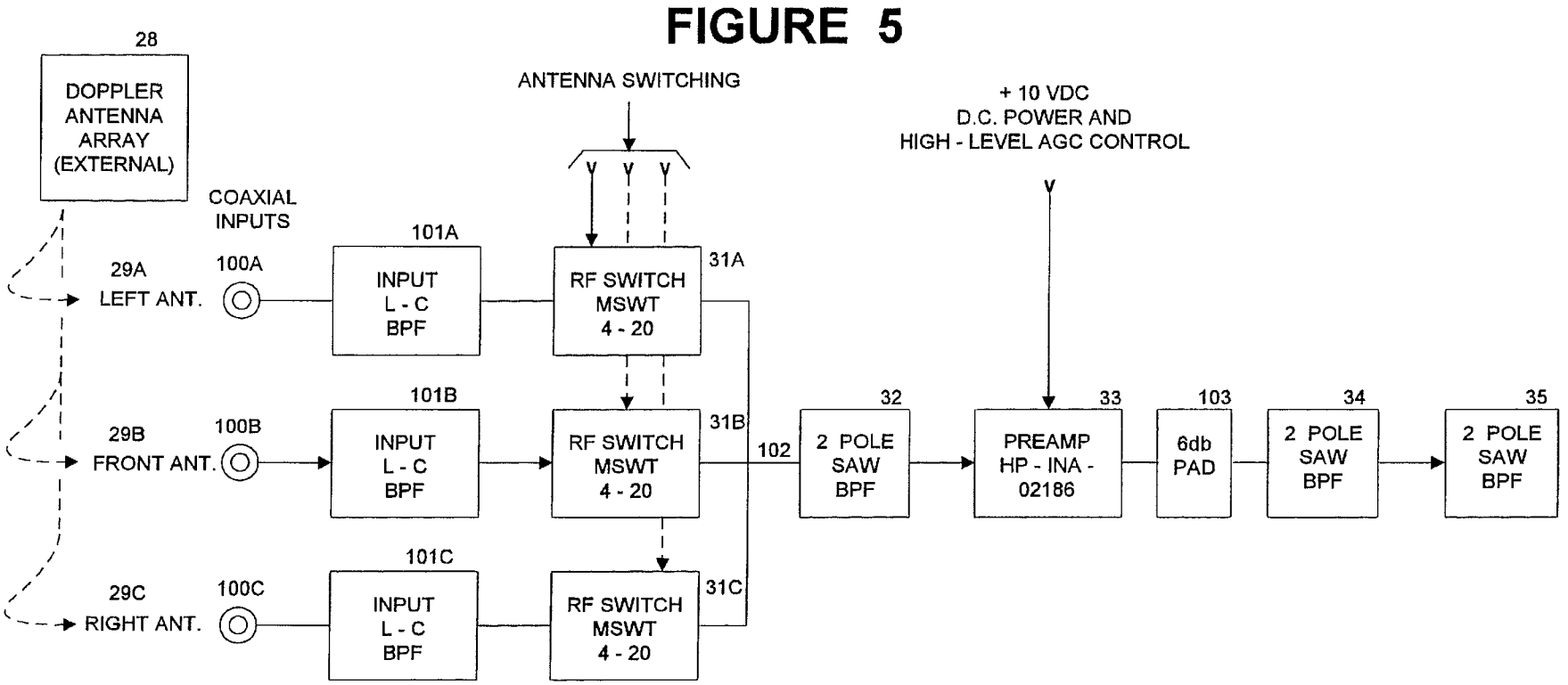
FIG. 5 illustrates a functional block diagram of the RF preselector.

A functional block diagram of the RF preselector 30 is shown in FIG. 5. The external Doppler antenna array 28 is an integral part of the overall tracking receiver direction finding (DF) operation. It consists of three quarter-wavelength vertically polarized antennas 20A, 20B, and 20C arranged in a triangular pattern over a ground plane with leg lengths between 0.13 and 0.17 wavelengths. The ground plane for the vertical antennas is normally supplied by the metallic skin of the tracking vehicle (ie. automobile, track, airplane, or helicopter). For non vehicle, fixed-site applications, antennas with radial ground planes are used. In operation, the received signal angle-of-arrival produces a unique phase pattern between individual antennas 20A, 20B, and 20C in the array 28. The receiver 27 then samples the individual antenna signals 29A, 29B and 29C to form one composite waveform which encapsulates the unique received phase pattern. The composite pattern is then processed by the single channel receiver 27. Unambiguous received angle-of-arrival data is obtained when the demodulated composite received phase pattern is compared to the original sequential antenna sampling waveform.

The RF preselector 30 has three coaxial antenna inputs 100A, 100B, and 100C, one for each antenna signal 29A, 29B, and 29C in the Doppler antenna array 28. Each antenna input 100A, 100B, and 100C has a parallel-timed, single section chip component L/C band pass filter circuit 101A, 101B, and 101C at the operating frequency of 220 MHz to provide a DC short for the prevention of static discharge build-up while adding additional rejection for out-of-band signals.

After the input band pass filter 101A, 101B, or 101C, each signal is coupled to a voltage-controlled switch 31A, 31B, or 31C for sequential commutation into a single channel output 102.

The sequential antenna commutation/switching operation is critical to the performance of the receiver 27. Any switching or commutation of an electrical signal becomes in effect a product multiplier (mixer), where sum and difference products of the input signal and the commutation rate are created. Because the switching/commutation operation is at the front end of the receiver, adjacent unwanted signals are modulated by the antenna switching. Due to the modulation, spectral sidebands on the adjacent signal carrier will be created with the spectral components spaced at intervals equal to the antenna commutation frequency of 407 Hz. The width of the spectral components on the original signal carrier is a function of the switching transition speed (transition rise and fall time). Short transitions create a wide spurious content and slow transitions create a narrow spurious content. Depending upon the adjacent signals level, frequency offset, and the transition rise and fall time times, spurious spectral components can easily fall within the receivers eight (8) kHz bandwidth and seriously degrade the ultimate sensitivity. The only known way to reduce this effect is to minimize the antenna switching transition times. An excellent text reference on this subject is Merrill Skolnik, RADAR HANDBOOK, Page 18–29, "Pulse Shaping," McGraw-Hill, New York, 1970, which states that the minimum pulse spectrum is obtained by a Gaussian shaped waveform. In an attempt to approximate this ideal, the digitally generated antenna switching control waveforms from the digital processor, when combined with the RF switch control voltage versus attenuation transfer function yields a roughly Gaussian waveform. Spurious spectral components generated by the antenna switching using this approach are typically 80 dB down to 10 KHZ from an adjacent carrier frequency.

The voltage-controlled analog switches 31A, 31B and 31C used to perform the antenna switching are MINI-CIRCUITS #MSWT 4-20, a monolithic GAS-FET integrated circuit containing four depletion mode GAS-FET RF switches internally connected in a bridge configuration with no active shunt elements to ground. Since these devices do not contain switching drive circuitry the attenuation can be continuously variable with an analog control voltage. The overall RF attenuation between opposite ends of the bridge configuration can be low (<1 dB), high (>35 dB), or any value in between depending upon the control voltage applied to the GAS-FET gate inputs. Overlap between the three switching waveforms minimizes amplitude changes and signal loss during transitions between adjacent antenna switches.

The common output 102 of the three analog switches 31A, 31B and 31C is connected to the first of three identical surface acoustic wave (SAW) band pass filters 32. These filters may be obtained from Phonon Corporation. They are narrow band (350 KHZ), two pole designs with low loss (<4 dB) and a close in floor of 30 dB. External input and output matching networks are required to match the standard 50 ohm impedances to the high impedances of the SAW devices. A tapped "L", shunt "C" parallel tuned matching network is used on each SAW filters input and output, except between SAW filters F2 and F3 where a single shunt "L" and "C" tunes out the internal SAW shunt capacitance of both devices. This type of matching network yields the best out of band rejection consistent with low insertion loss.

After the first SAW bandpass filter 32, the signals allowed to pass through the filter are amplified by a low noise, broad band, bipolar integrated circuit amplifier 33. The device used in the preferred embodiment is a Hewlett Packard #INA-02186. This IC amplifier has a noise value of less than 3.5 dB, 33 dB of gain, and is designed to operate in a 50 ohm impedance environment. Immediately following the preamplifier stage is a 50 ohm six dB resistive "T" pad, which was required for stability over the designed operating range of −20 to +70 degrees Celsius.

The remaining two cascade SAW filters 34 and 35 are connected to the "T" pad output to provide additional RF selectivity for good image frequency rejection and reduction of adjacent signals before the RF Preselector output 36 is applied to the IF circuitry 40 for conversion to a fixed IF frequency.

Figure 6:
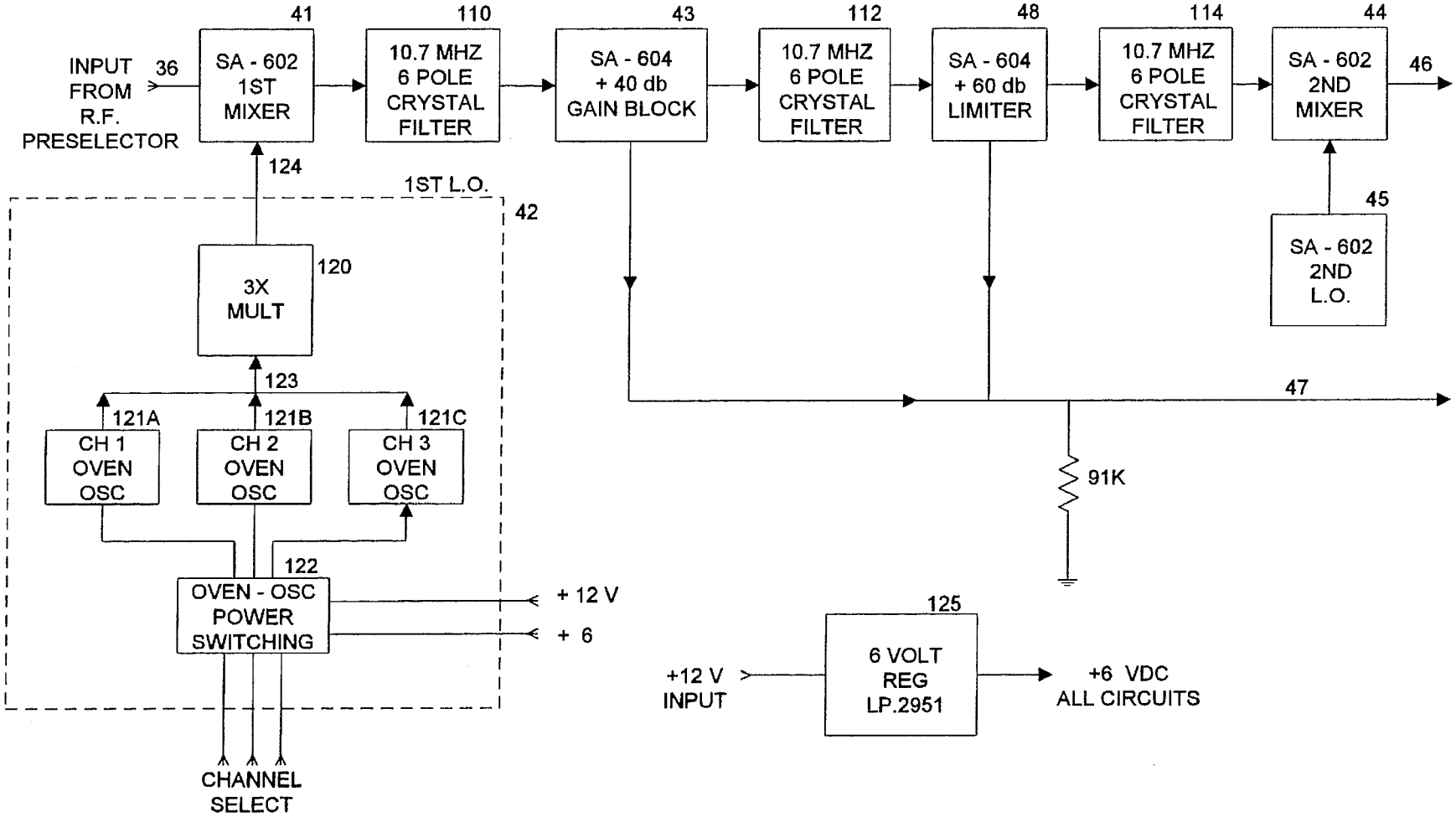
FIG. 6 illustrates a functional block diagram of the IF circuitry, including the filter and local oscillator (LO) subassembly.

A functional block diagram of the IF circuitry 40 is shown in FIG. 6.

The tracking receiver is designed to operate on one of three frequency channels within the RF preselector 30 bandwidth of 350 KHz. Currently, the three channels are centered at CH1-219.93, CH2-219.96, and CH3-219.99 MHz. Channel selection is automatically set to channel two upon receiver power-up, but can be changed by operator via controls on the display unit 90. The RF channel select information 83 is sent to the 1st LO 42 via individual logic control lines from the DSP 80. When a particular channel is selected, a "N" channel MOSFET switch (International Rectifier #—IRF7103) is enabled which switches the primary DC power (+12 volts dc), from the vehicle power or from an external DC supply, to the appropriate crystal oven heater. At the same lime, a "P" channel MOSFET switch (ZETEX #BS-250) applies 6 V from DC regulator 125 to the associated crystal oscillator circuit. Only one oscillator can be enabled at any given time.

When enabled, each of the three crystal oscillator circuits 121A, 121B, and 121C operate at a frequency equal to one third of the (channel frequency center +10.7 MHz). They are single transistor (NEC-94433) crystal controlled discrete component circuit designs using a modified form of the basic Colpitts oscillator configuration. The individual outputs from all three oscillators 121A, 121B, and 121C are combined into a single common output 123.

The common RF output 123 from the three oscillators 121A, 121B, and 121C is applied to the X3 multiplier circuit 120 where the third harmonic of the enabled oscillator frequency is extracted and increased in power level to zero dBm for the active 1st Mixer circuit 41. The X3 multiplier circuit 120 contains three discrete component "L/C" tuned RF transistor amplifier circuits. The first stage amplifier is a common base configuration using a (NEC-94433) bipolar transistor. A common emitter configuration with the same transistor type is used for the second stage. The third stage amplifier is a common emitter configuration using a (NEC-85633) bipolar transistor. A "PI" matching network is used at the final output for load isolation.

The 1st mixer 41 performs a product multiplication on RF input signals 36 from the RF Preselector 30 and the 1st local oscillator (LO) 42; creating sum and difference frequencies of the two inputs. Since the 1st LO input 124 is designed to be 10.7 MHz above the desired input frequency, one of the products, the difference product, will be 10.7 MHz. Conversion of the input signals 36 from 220 MHz to a much lower intermediate frequency (IF) of 10.7 MHz allows the use of components that can provide better gain and selectivity. The 1st mixer 41 will also convert unwanted RF input signals that are 10.7 MHz above the LO frequency into an output of 10.7 MHz. The effect of this undesired response (image response) is reduced by good RF selectivity at the desired RF response and high rejection at the image frequency. The typical image rejection of this receiver is 90 dB, due primarily to the SAW band pass filters 32, 34, and 35 in the RF preselector 30. The device used to perform the mixer function is a PHILIPS #SA602A, an integrated circuit specifically designed for mixer applications to 500 MHz with a built in local oscillator circuit. In this application, the 50 ohm RF input 36 from the RF preselector 30 is matched to the 1500 ohm RF input of the 1st mixer 41 with a tapped "C", shunt tuned "L/C" RF circuit. The internal oscillator circuit of the 1st mixer 41 is disabled and the output 124 of the crystal controlled 1st LO 41 is directly injected into a LO buffer on the integrated circuit. The IF output signals of the 1st mixer 41 are fed to the first 10.7 MHz crystal filter 110 in the IF circuitry 40.

The IF circuitry 40 utilizes three (3) crystal filters 110, 112, and 114 for selectivity and two IF amplifier integrated circuits 111 and 113 for gain. All of the crystal filters 110, 112, and 114 are standard six (6) pole designs, with a center frequency of 10.7 MHz and a three (3) db bandwidth of 7.5 kHz (available from most filter manufacturers). They require a "L/C" matching circuit on the input and output to tone out shunt and stray capacitance and also for impedance matching to and from the integrated circuit amplifiers. The filters are used between the 1st mixer 41 and the 1st IF amplifier 43, between the 1st IF amplifier 43 and 2nd IF amplifier 48, and the 2nd IF amplifier 48 and the 2nd Mixer 44. The combined IF selectivity is very sharp for adjacent signal rejection.

Each of the two IF amplifiers 43 and 48 are PHILIPS #SA-604A. They have independent 40 dB and 60 dB wide band (25 MHz) limiting type amplifier gain blocks with a common Received Signal Strength Indicator (RSSI) and a quadrature FM detector circuit (not used in this application). Normally one SA-604A integrated circuit could have met the total IF gain requirements, but due to the relatively large physical size of the three crystal filters 110, 112 and 114 and the resulting long interconnection leads to a small surface mount IC, stable operation is difficult to achieve with a single SA-604A IF integrated circuit amplifier. To achieve stability, a compact straight line layout is used where the total IF gain is divided between two different SA-604A integrated circuits. In the 1st IF amplifier 43, only the +40 db gain section is used between the 1st crystal filter and 2nd crystal filter 112. The 2nd IF amplifier 48 uses only the +60 dB gain section between the 2nd crystal filter 112 and 3rd crystal filter 114. Since the SA-604A RSSI output level is represented as a current to ground, outputs from the two IF amplifiers 43 and 48 are easily combined and converted to voltage form by a single resistor to ground. The combined RSSI has a logarithmic response greater than 90 dB and is fast enough to function as a wide dynamic range amplitude demodulator (AM). It is sampled by the DSP 80 to extract signal level and AM modulation dam and is also used in the high level AGC 61.

The 2nd mixer 44 performs a product multiplication on IF input signals from the 2nd IF amplifier 48 and the 2nd LO 45; creating sum and difference frequencies of the two inputs. Since the 2nd LO 45 input is designed to be 9.47 KHz above the desired input frequency, one of the products, the difference product, will be 9.47 KHz. Conversion of the input signals from 10.7 MHz to a much lower intermediate frequency of 9.47 KHz is necessary to put the signal frequency in a range where it can be easily sampled with an analog to digital A/D converter for use by the DSP 80. The 2nd mixer circuit 44 also converts unwanted IF input signals that are 9.47 KHz above the LO frequency into an output (image response). Even though the signal is well filtered, the hard limited output of the 2nd IF amplifier 48 contains many spurious intermodulation and harmonic products some of which can fall within the 2nd mixer circuit's 44 image response. These spurious products are reduced by the selectivity of the 3rd crystal filter 114. The device used to perform the mixer function is a PHILIPS #SA602A, an integrated circuit specifically designed for mixer applications to 500 MHz with a built in Local Oscillator circuit. The 1st IF output from the 3rd crystal filter 114 is matched to the 1500 ohm input of the SA602A 2nd mixer 44 with a series "C", off of the shunt filter matching circuit. The internal oscillator circuit of the 2nd mixer 44 is configured to operate as a parallel mode crystal oscillator with a fundamental 10.709469 MHz crystal. The 9.47 KHz output signals of the 2nd mixer 44 are fed to an external amplifier for amplification before A/D conversion by the DSP 80.

All of the oscillator, mixer, and amplifier circuits in the IF circuitry 40 are powered from a National #LP-2951 DC regulator 125. The primary unregulated power input for the DC regulator 125 is supplied by the external +12 volt DC source, such as a car battery.

Figure 7:
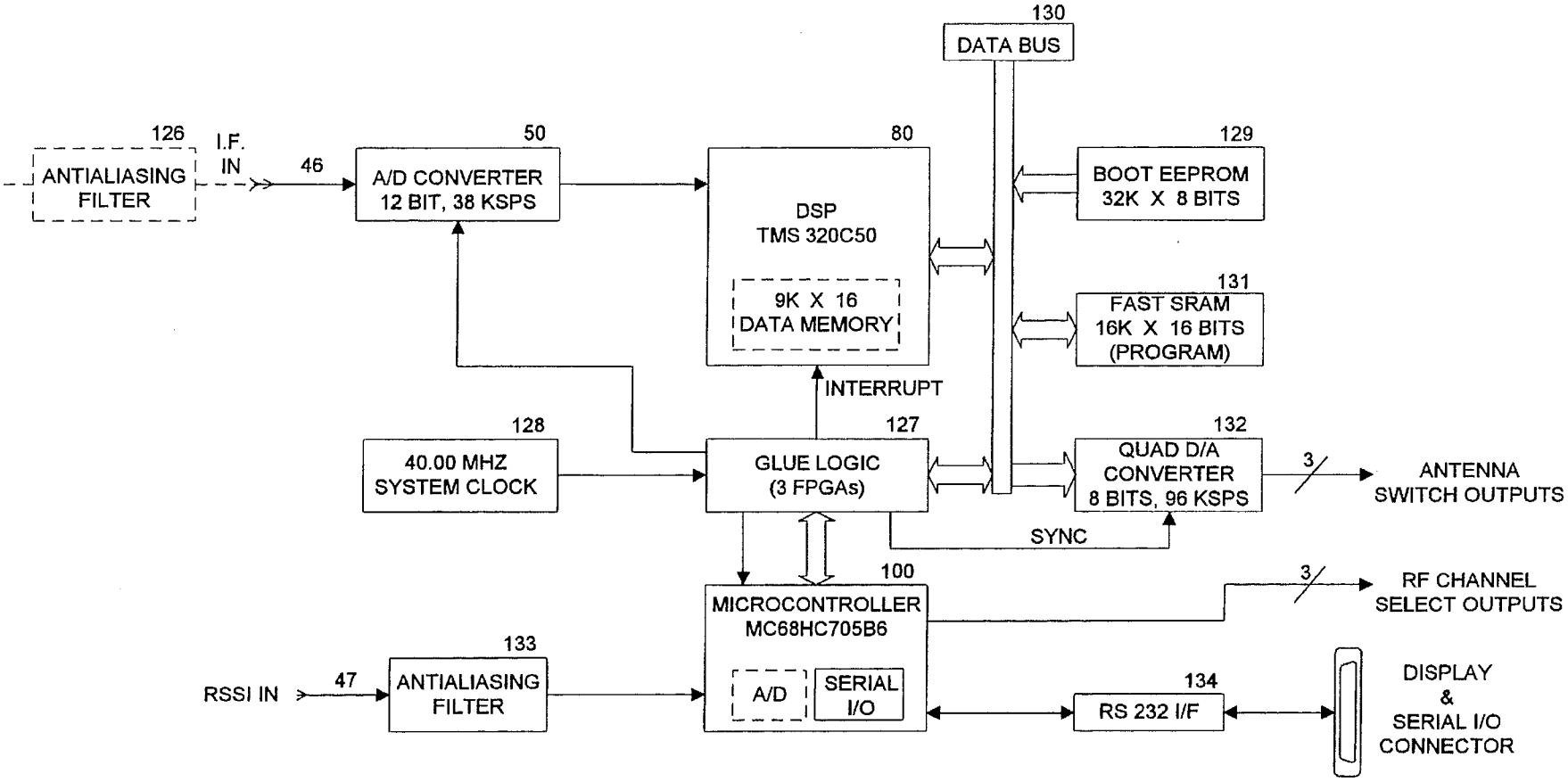
FIG. 7 illustrates a block diagram of the DSP and related components.

FIG. 7 shows the DSP 80 and related circuitry in block diagram form. The DSP 80 is responsible for executing the baseband signal processing algorithms and for outputting the results of these to the display. It also coordinates operations throughout the receiver. These tasks are segregated into signal processing and supporting functions.

The digital signal processor 80 is implemented using a Texas Instruments TMS320C50. The system clock 128 frequency is 40.00 MHz, resulting in an instruction cycle time of 50 ns. This device was chosen because of its relatively large internal RAM size (9K words), a necessary requirement for processing large fast fourier transform algorithms (FFT's). The internal RAM is used for data manipulation and storage because of its faster access time when compared to off-chip data storage implementations. Off chip writes always incur at least a one wait state penalty.

The system clock 128 is a generic 40.00 MHz CMOS compatible oscillator module, available from a number of sources. Its stability should be ±25 ppm to ensure that the oscillator's frequency harmonics do not fall within RF channel passbands of ±4 kHz. The clock output is distributed to the DSP 80 and the glue logic 127.

In the preferred embodiment, the baseband A/D sampling is implemented using a MAX191 12 bit, 38 ksps A/D converter 50. It is connected to the DSP 80 via a separate serial data interface to provide increased isolation from the logic switching noise generated elsewhere in the system. The 37.8788 kSa/s conversion rate is controlled by glue logic 127 in the FPGAs, and provides sampling bandwidth adequate to cover the 9.470 kHz ±4 kHz passband. The 11-bit plus sign quantization achieves greater than 66 dB dynamic range, and can accept inputs up to ±2.5 V peak amplitude.

In operation, the RSSI input 47 is passed through anti-aliasing filter 133 and sampled using the microcontroller's 100 internal 8 bit A/D converter. The DSP 80 outputs a strobe signal at 394.6 Sa/s which interrupts the microcontroller 100 for RSSI sampling. This sampling rate is adequate for both the 90 Hz tone modulation and the approximately 50 bps waveforms potentially present. The RSSI sample is made available to the DSP 80 via FPGA's in glue logic 127. The baseband input 46 may optionally be passed through anti-aliasing filter 126, and is then passed to the A/D converter 50.

The output D/A function is implemented using a MAX505 quad 8 bits, 96 ksps D/A convertor 132 from Maxim. It is connected to the DSP's parallel data bus 130. Address decoding and a 37.8788 kSa/s synchronizing strobe are provided by glue logic 127.

Referring back to FIG. 4, three of the D/A convertor's outputs 71A, 71B an 71C, form the 3-phase antenna switching waveforms for antenna switch controls 72. These channels are provided with a variable reference and offset which allows adjustment of the waveforms for optimum switching performance.

The fourth channel of the D/A convertor 132 is provided with a fixed reference, and is used to output one often selected data streams from within the DSP 80 algorithm. This provides a "virtual probe" to examine waveforms which exist only in the firmware, and aids in calibration, field setup, and troubleshooting. Several of these are also used to output data from the receiver 27 to other equipment.

The program memory 131 is implemented using a Motorola MCM62996. A device utilizing static RAM (SRAM) architecture was chosen over erasable programmable, read-only memory (EPROM) implementations because it combines fast access speed with in-system alterability. (Fast EPROMs are available, but cannot be reprogrammed easily.) The program memory 131 has 16K× 16 architecture, which matches the word width of the DSP 80, providing a single IC implementation. The DSP 80 allows writes to this program memory 131, but its normal operating mode is read-only; achieving zero wait state accesses by the DSP 80. The program memory 131 is interfaced to the DSP 80 via its parallel data bus 130. Address decoding is partial; i.e., the device is aliased a total of four times in the DSP's 80 64K program space. This was done to simplify glue logic 127 requirements.

Since the program memory 131 is volatile, a permanent storage must be provided. An electronically erasable programmable read-only memory (EEPROM) solution is desirable to provide reprogrammability should firmware changes become necessary; however, even the fastest EEPROMs cannot directly function as DSP program memory without wait cycles. This function is implemented using a Xicor X28C256 32K×8 EEPROM IC 129.

This EEPROM 129 is interfaced to the DSP 80 via its parallel data bus 130, and functions as global data memory. The DSP 80 contains a built-in bootstrap loader algorithm, which can read global data memory (at reduced speed) and transfer its contents into program memory 131. This algorithm can be invoked whenever the DSP 80 is reset.

The hardware is constructed so that it is impossible for the DSP 80 to write to the EEPROM 129; instead, its write-enable is directly connected to the support microcontroller 100. The microcontroller 100 can seize control of the DSP's parallel data bus 130, when necessary, via the glue logic 127; it can then modify the contents of the EEPROM 129.

The glue logic 127 is required by the DSP 80 block and is condensed into three ISPLSI1016 field programmable gate arrays (FPGAs) built by Lattice Semiconductor. These devices are programmable onboard after assembly, and can be reprogrammed if necessary. The primary functions of the glue logic 127 are: system time base generation, address decoding, providing a bidirectional data pathway between the DSP 80 and microcontroller 100, and providing microcontroller 100 access to the DSP data bus 130.

The first of the FPGA's in the glue logic 127 is configured as a cascade of synchronous counters; these provide all clock signals for the DSP 80. Thus, all clock signals are coherent with the system clock 128, and the potential for switching noise injection into the baseband and RSSI samplers is minimized. A 2.00 MHz 50% duty cycle microcontroller clock, a 1.25 MHz 50% duty cycle A/D convertor clock, and a 37.8788 kSa/s sampling strobe are provided.

The second FPGA in the glue logic 127 is primarily configured to interface the DSP 80 to the microcontroller 100. This is achieved by implementing three 8 bit write-only registers for the DSP 80. These are intended to pass a status/RSSI byte, DF phase byte, and a transmitter type code byte respectively; they are read-only to the microcontroller 100. In the reverse direction, two 8 bit registers are implemented (read-only to the DSP 80; write-only to the microcontroller 100). These communicate a command byte and the RSSI sample data to the DSP 80. These FPGA registers may be written at the DSP's 80 full access speed, thus minimizing the time input (on the DSP 80) of communicating with the relatively slow microcontroller 100. Additionally, one register in each direction can be used to provide microcontroller 100 access to the low byte of the DSP's data bus 130 for bootstrap EEPROM 129 reprogramming.

The third FPGA in the glue logic 127 is configured primarily as an address decoder. It accepts the sixteen address signals and the four memory section signals and outputs chip selects for the D/A convertor 132, the EEPROM 129, and partially decodes addresses for the second FPGA in glue logic 127. Additionally, three 8 bit registers are implemented which are write-only for the microcontroller and tri-state outputs to the address and segment signals. These provide the access mechanism for the microcontroller 100 to the DSP's address buses 130 during EEPROM 129 reprogramming.

The microcontroller 100 is implemented using an MC68HC705B16 from Motorola. This device is similar to that used in the display 90, and includes an internal 8 bit A/D convertor, multifunction time subsystem, and an asynchronous serial communications subsystem; it also contains a small array of byte accessible EEPROM. This device receives a 2.00 MHz clock from the glue logic 127.

Sixteen of the peripheral I/O pins of microcontroller 100 are used to implement a bidirectional parallel data bus connection to the glue logic 127. This bus is normally used to pass RSSI samples and operating mode data to the DSP 80, and to receive DF data, signal strength, alert type code, and status flags from the DSP 80. Three of the microcontroller's 100 outputs provide RF tuning by selecting one of three 1st local oscillators as requested by the operator. Additional outputs are used as DSP reset, and DSP hold controls; the latter causes the DSP 80 to tri-state its bus drivers so that the microcontroller 100 can gain access.

An external interrupt is provided by the DSP 80, and prompts the microcontroller 100 to sample the RSSI waveform from anti-aliasing filter 133 and present the sample to the DSP 80 via the glue logic 127.

The DSP 80 supplies an interrupt to the microcontroller 100 every 2.5 ms, which signals the microcontroller 100 to read a sample from its on-board A/D convertor. The sample is transferred directly to the DSP 80 via the glue logic 127.

The asynchronous serial communications interface (SCI) of the microcontroller 100 implements the logic portion of the RS232 interface 134. It is configured for operation at 4800 baud, 8 bits, no parity, and one stop bit. It transmits periodic status strings, and accepts system command strings under control of firmware. The RS232 interface 134 is implemented using a MAX236 from Maxim. This block performs a voltage translation on the serial data streams entering and leaving the receiver 27. It converts the internal logic level signals ranging between 0 V and +5 V, to a bipolar signal ranging between +8 V and −8 V, and vice-versa. It additionally provides approximately 2 KV electrostatic discharge protection for the signals it interfaces to.

The EEPROM array within the microcontroller 100 is utilized to retain receiver setup data while power is removed. DF phase offset is saved, along with pointers for 13 calibrations within the DSP 80.

Figure 8:
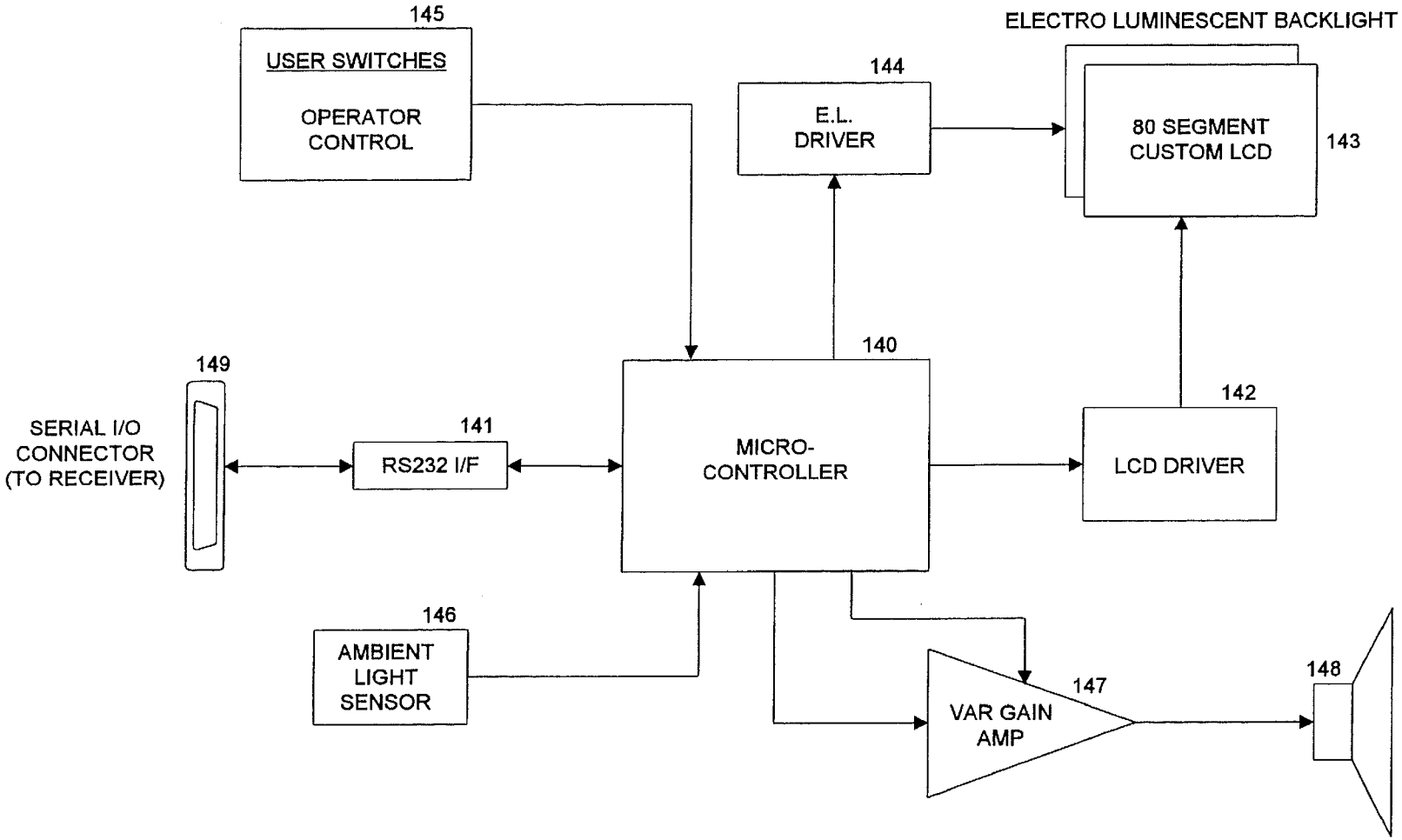
FIG. 8 is a block diagram of the display unit.

FIG. 8 shows the basic operation of the display unit 90. The display unit 90 is implemented utilizing a microprocessor based design; as such, it is composed of hardware components, and of firmware which accomplishes its specific functions.

The display communicates with the receiver 27 via display RS232 interface 141, much like receiver RS232 interface 134. While this results in slightly increased circuit complexity when the receiver 27 and display 90 are directly joined, the more typical application sees the display 90 remote from the receiver 27. Additionally, the display 90 appears as a generic serial device to the receiver 27, so that separate serial port and display drivers are not required.

The MC68HC705B5 microcontroller 140, from Motorola, is the central component of the display 90. It includes internal hardware to implement serial data communications with the receiver 27; operate the LCD driver 142, EL driver 144, and audio alarm 148; and monitor the user switches 145.

A custom LCD 143 is utilized for all visual communication to the user. This component is specified for extended temperature operation (−20 deg to +70 deg C.) suitable for automotive applications. The LCD 143 is directly driven by LCD driver 142 (non-multiplexed) for improved viewing angle without an operator contrast control. It is transflective, so that it may be illuminated by available ambient light, or supplemented by an electro-luminescent (EL) back light.

The LCD 143 contains a 22 element radial pointer pattern, giving a display resolution of 11.25 degrees per segment in the forward semicircle and 33.75 degrees per segment in the rear semicircle. The forward semicircle is emphasized by making it larger than the rear; this achieves a more legible display without increasing the overall size of the radial pattern.

The received signal strength indicator (RSSI) is implemented as a tapered twelve segment bar graph. It normally operates in bar mode; however, the receiver software can be reconfigured to display FFT tuning information. When this mode is invoked, the display is used in dot mode.

Two seven segment digits are implemented on the display 90. The first is normally used to indicate the selected RF channel. The second displays the beacon type code; currently five are defined, and are differentiated by modulation encoding. When in calibration mode, these digits show selected function and selected value, respectively.

Eight indicator flags are also implemented on the display 90; these depict the following status: PLL lock, alert, back light adjust mode, continuous/FFT display mode, phase adjust mode, serial communications failure, audio mute, and DC power on.

During normal operation, most of the LCD 143 is disabled; the direction indicator and RSSI bar graph are only active when a validated signal is present. This minimizes distractions to the operator.

The LCD driver 142 is implemented using a Hitachi device. LCD driver 142 directly drives the LCD 143. It is serially loaded by the microcontroller 140, and latch holds the data until the next update is required. The microcontroller 140 also supplies a clock signal to the LCD driver 142 which generates the AC waveforms required for LCD longevity.

The audio amplifier 147 is implemented using a Phillips amplifier IC, followed by a discrete push-pull bipolar transistor amplifier stage. The audio amplifier 147 provides a variable audio gain block which is controlled by a DC signal from the microcontroller 140. The signal source is a variable frequency, fixed amplitude square wave which is also generated within the microcontroller 140.

The microcontroller 140 is programmed as follows. Ten times each second, the microcontroller 140 inputs the status of the user switches 145. Depending upon which are closed, it may then alter mute status, audio level, back light level, RF channel, phase (DF) calibration, or receiver setups. The user has immediate access to volume adjust, audio muting, and back light adjust. The other adjustments are protected from inadvertent alteration by requiring multiple key closures or extended time closures.

The audible alarm 148 is coupled to audio amplifier 147 and is implemented as a timed interrupt with a variable interrupt rate. The interrupt rate is varied to generate a square wave in the range of 230 Hz–1760 Hz. It is gated off when no alert is present or when muting is invoked. The mute function is automatically reset two seconds after the alert terminates, or can be manually terminated by closing the switch a second time. Each time a RSSI update is received from the DSP 80, it is input to a smoothing algorithm; this algorithm's output determines the output frequency via a look-up table.

The serial I/O algorithm is interrupt driven. Incoming characters are stored in a buffer area in RAM until a complete string is received. String data is then available to the LCD formatter algorithm. Outgoing command strings for the receiver are accumulated in a separate buffer area.

The LCD update subroutine rims 10 times each second, independently from the serial communications algorithm. The incoming data string selects one of two LCD display modes: an operational display with active DF and RSSI indicators, and a calibration display which utilizes only the seven segment digit portion of the display. The algorithm computes which DF segment to activate, and how may bar graph segments to turn on. These bit patters are then serially shifted into the LCD driver 142. Additionally, RF channel and alert type codes are used to reference a look-up table of bit patterns which are also transferred to the LCD 143. Finally, the various status flags are sent to the LCD 143.

The LCD back light is implemented using an electroluminescent (EL) panel and ISP3236A EL driver 144, both from BKL. The EL driver 144 supplies a waveform to the EL panel of the LCD 143 whenever backlighting is required. Intensity is controlled by varying the supply voltage to the EL driver 144; this has the effect of varying the AC voltage to the EL panel. The microcontroller supplies a variable DC voltage to an operational amplifier and emitter-follower stage which regulates the DC supply voltage to the EL driver 144. A light sensor IC 146 from Texas Instruments is used to modify the supply voltage to the EL driver 144.

Six momentary contact push-button switches implement the user switches 145. These are arranged in two groups of three: an audio control group and a calibration/setup group.

The display 90 receives 12 V DC from an interconnect cable; and internal regulator supplies +5 V DC for the microcontroller 140 and the LCD driver 142. National Semiconductor's LP2951 is used for this function. Discrete components provide self-resetting fusing, transient protection, and reverse voltage protection.

The display 90 is enclosed in an all metal enclosure which combines durability with easy manufacture. It is formed in two pieces; the upper portion incorporates an anti-glare shade for the LCD 143.

The display 90 is interfaced to the receiver 27 via a 15 pin D-sub I/O connector 149. This I/O connector 149 includes the standard serial data signals as well as DC power. The I/O connector 149 is located so that the display 90 and the receiver 27 may be joined without an interconnect cable, and installed as a single unit into an automobile's console, etc. When this is done, an additional attachment bracket is useful.

Figure 9:
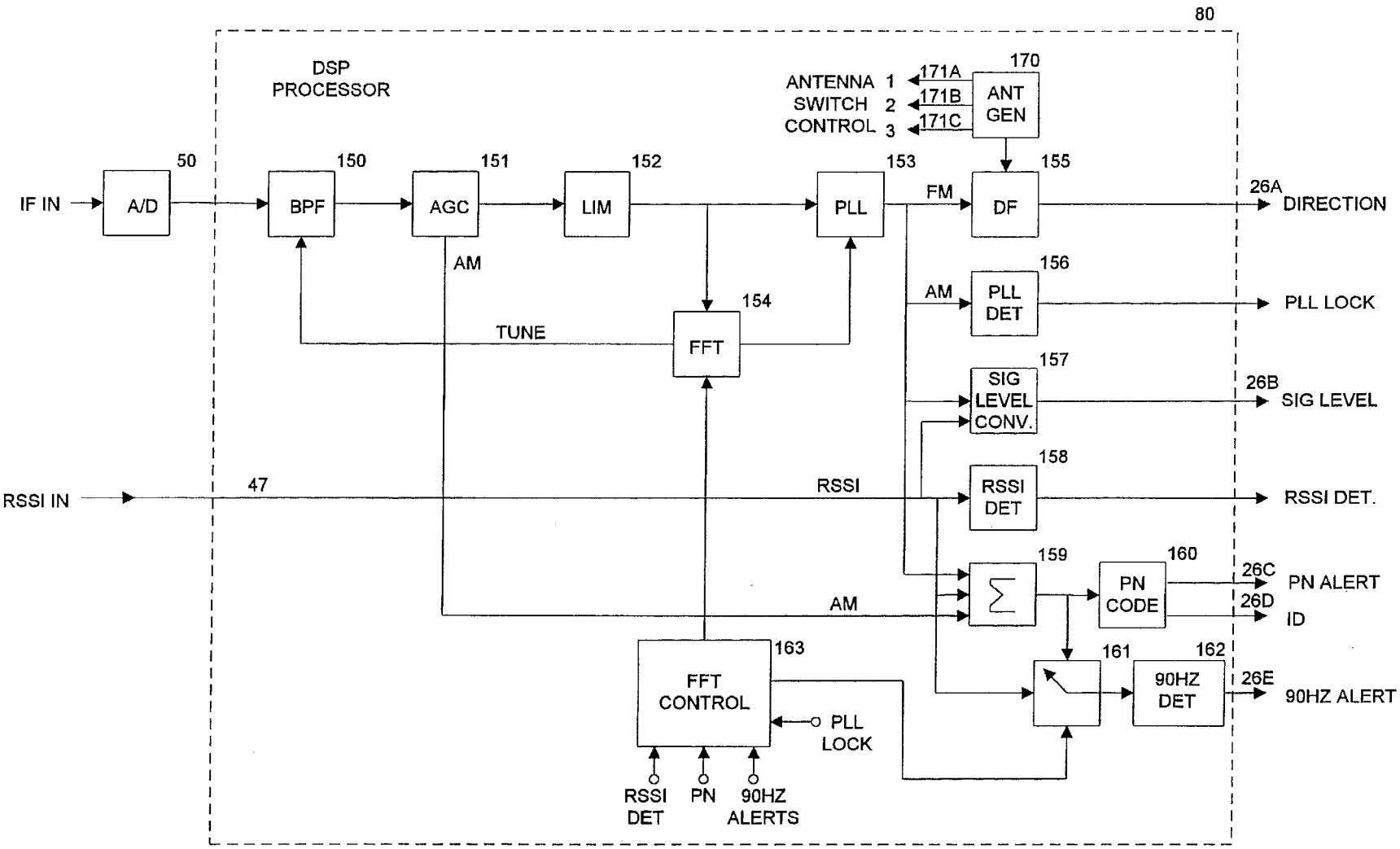
FIG. 9 illustrates in more detail the DSP.

Shown in FIG. 9 is a block diagram of the functions performed by the DSP 80. The A/D converter 50 provides the digital inputs to the DSP 80. The signal is then applied to a digital 2-Pole band-pass filter (BPF) 150 with a 1 kHz BW which is digitally tuned to the correct frequency by the FFT controller 163.

The signal is then adjusted in level by the AGC 151 if the signal level is too low to account for the noise bandwidth reduction of 8-to-1 kHz. AGC 151 is not active during normal operation, resulting in decreased circuit noise. AGC 151, when active, allows the gain of the digital PLL to remain constant at low signal-to-noise ratios. The signal is then limited by limiter 152 and applied to the FFT processor 154 and the digital PLL 153.

The DSP 80 performs a 2048 point FFT at a sample rate of 37878 samples per second which results in a bin resolution of 18.5 Hz. The DSP 80 then averages ten FFT's and selects the frequency bin with the maximum amplitude. The phase-locked loop (PLL) 153 and the BPF 150 are then tuned to this frequency.

The PLL 153 locks to this frequency and operates with a 25 Hz natural frequency and a damping factor of 0.707. The PLL 153 provides an FM detected output and a quadrature AM-detected output. The FM output is applied to the direction finding (DF) processor 155 which filters the FM antenna modulation signal in a 0.5 Hz BPF. This signal is then multiplied by quadrature sine and cosine references of the antenna switching rate. These signals are then converted to tangent values, which normalizes the amplitude components and allows a calculation of the measured angle from the tangent function. This angle is then provided to the display 90 for a 360 degree indication of the relative direction to the signal.

The antenna signal generator 170 provides the reference signal to the DF processor 155 and generates the three antenna switching signals 171A, 171B, and 171C. These signals are Gaussian shaped pulses generated from Gaussian look-up tables and are each 120 degrees apart in phase. The digital signals are then D/A converted by waveform generator 70 and applied to the analog RF switches 31A, 31B, and 31C for the three RF antennas 20A, 20B, and 20C.

The AM output of the PLL 153 is detected by PLL detector 156 to indicate when the PLL 153 is locked. The signal level converter 157 sums the output of the PLL AM detector 156 with the RSSI signal 47 from the receiver 27 (after A/D conversion) to produce a signal level indication when the receiver 27 is limiting (RSSI) and when the signal is below the noise in the 8 kHz BW (AM PLL) to produce a signal level indication from −30 dBm to −145 dBm.

The RSSI detector 158 is used to provide input to the DSP 80 to determine if false lock has occurred when using the 90 Hz tone for the signal alert information 26E.

The RSSI signal 47 and the PLL 153 and DSP 80 outputs are summed together to provide the inputs to the PN code detector 160 and the 90 Hz Tone detector 162. These inputs are summed in summer 159 to provide the full range of AM detected signals over the −30 to −145 dBm input signal range. The RS SI detector 158 provides the AM detected signal in the range of −30 to −130 dBm while the DSP 80, AGC 151, and PLL 153 provide the AM detected signal over the −130 to −145 dBm range of input signals. The RSSI signal is necessary since the receiver 27 uses a hard-limiting IF amplifier circuit which requires no AGC during normal operation but produces an RSSI level output which is proportional to the input signal level.

The PN code detector 160 is a 64-Bit PN sequence-matched filter detector with an 8-bit Data ID detector. The PN code detector 160 is also used to identify 4 unique ID's to allow identification of different transmitter types to be used for different types of applications.

The 90 Hz tone detector 162 is included to allow operation with existing transmitters in current operation.

The FFT controller 163 provides for the basic operation of the receiver. The FFT controller 163 provides for the acquisition of the signal in the 8 kHz BW (by means of the FFT) and provides the timing to switch 161, allowing the PN code detector 160 or the 90 Hz Tone detector 162 to detect the desired signal with the desired AM modulation (PN or 90 Hz) and decide when to start a new acquisition when the desired signal is lost.

When prompted by its internal timer, the FFT controller 163 outputs a string of status information to the display 90 or other attached serial device. When in normal operation, the string includes flags for alert, PLL lock, barograph display mode, continuous display mode. Current RSSI level, DF bearing, selected RF channel, and alert type code are also reported.

When the timer interrupt occurs, the FFT controller 163 first accesses the registers in the second FPGA in the glue logic 127, and imports data from the DSP 80. When in normal operating mode, the microcontroller 100 then adds the phase calibration to the raw phase data from the DSP 80. An ASCII string is then assembled in buffer RAM and output utilizing the serial port (transmit) interrupt. The outgoing string takes one of two forms: the normal, status update string described above; and a shorter, calibration mode string. Presently, thirteen calibrations are defined; these adjust various thresholds and offsets in the DSP. The first character sent identifies the operating mode. When in any calibration mode, the second character depicts the value of a pointer to a table of possible selections, implementing a rotary switch function. A separate pointer is maintained for each calibration in nonvolatile storage. Adjustment is implemented by utilizing the pointer setting to reference a look-up table for calibration; the selected value is retrieved from the table and is programmed into the EEPROM 129 via the glue logic 127 whenever a pointer is altered. The DSP 80 is held in reset while this is completed; when reset is released the DSP 80 loads the new value from the EEPROM 129 and the change is complete.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. A portable receiver for identifying and tracking a portable transmitter that emits a radio frequency signal, said receiver comprising:

a plurality of antennas for receiving said radio frequency signals;

switching circuitry coupled to said antennas for switching between said antennas, said switching circuitry having an output signal;

radio frequency circuitry coupled to said switching circuitry for processing said output signal, said radio frequency circuitry producing a radio frequency signal;

intermediate frequency circuitry coupled to said radio frequency circuitry for converting said radio frequency signal into an intermediate frequency signal;

an analog-to-digital converter for converting said intermediate frequency signal into a digital signal;

a digital signal processor for processing said digital signal to determine the relative location of said receiver with respect to said transmitter, said digital signal processor comprising identifying circuitry for identifying whether said digital signal corresponds to said transmitter, locking circuitry communicating with said identifying circuitry for tuning said receiver in response to said digital signal, and detector circuitry for determining the direction to said transmitter from said receiver.

2. The receiver of claim 1 wherein said plurality of antennas are Doppler antennas.

3. The receiver of claim 1 wherein said plurality of antennas are at least three in number and are configured such that one of each of said plurality of antennas is located on the vertex of an equilateral triangle.

4. The receiver of claim 1 wherein said switching circuitry is responsive to an analog waveform.

5. The receiver of claim 4 wherein said analog waveform is Gaussian shaped.

6. The receiver of claim 1 wherein said digital signal processor includes an instantaneous hard-limiting AM/FM receiver.

7. The receiver of claim 1 wherein said identifying circuitry includes a coherent AM detector.

8. The receiver of claim 7 wherein said digital signal processor includes a summer for summing the output of said coherent AM detector with a received signal strength indicator signal to extend the dynamic range of said receiver.

9. The receiver of claim 8 wherein said receiver does not use automatic gain control during normal operation.

10. A system for transmitting, identifying and tracking a radio frequency signal, said system comprising:

a portable transmitter for transmitting said radio frequency signal;

a receiver for receiving and processing said radio frequency signal including a plurality of antennas for receiving said radio frequency signal;

switching circuitry coupled to said plurality of antennas for switching between said antennas, said switching circuitry having an output signal;

radio frequency circuitry coupled to said switching circuitry for processing said output signal, said radio frequency circuitry producing a processed radio frequency signal;

intermediate frequency circuitry coupled to said radio frequency circuitry for converting said processed radio frequency signal into an intermediate frequency signal;

an analog-to-digital converter for converting said intermediate frequency signal into a digital signal; and a digital signal processor for processing said digital signal, said digital signal processor containing identifying circuitry for identifying whether said digital signal corresponds to said portable transmitter, locking circuitry communicating with said identifying circuitry for tuning said receiver in response to said digital signal, and detector circuitry for determining the direction to said transmitter from said receiver; and display circuitry coupled to said receiver for displaying said direction to said transmitter from said receiver.

11. The system of claim 10 wherein said plurality of antennas are Doppler antennas.

12. The system of claim 10 wherein said plurality of antennas are at least three in number and are configured such that one of each of said plurality of antennas is located on the vertex of an equilateral triangle.

13. The system of claim 10 wherein said switching circuitry is responsive to an analog waveform.

14. The system of claim 13 wherein said analog waveform is Gaussian shaped.

15. The system of claim 10 wherein said digital signal processor includes an instantaneous hard-limiting AM/FM receiver.

16. The system of claim 10 wherein said identifying circuitry includes a coherent AM detector.

17. The receiver of claim 16 wherein said digital signal processor includes a summer for summing the output of said coherent AM detector with a received signal strength indicator signal to extend the dynamic range of said receiver.

18. The system of claim 17 wherein said receiver does not use automatic gain control during normal operation.

19. A method for identifying and tracking a portable transmitter that emits a radio frequency signal, said method comprising the steps of:

receiving said radio frequency signals with a receiver having a plurality of antennas;

switching between said antennas with switching circuitry, said switching circuitry having an output signal;

processing said output signal so as to produce a processed radio frequency signal;

converting said processed radio frequency signal into an intermediate frequency signal;

converting said intermediate frequency signal into a digital signal; and processing said digital signal, including identifying whether said digital signal corresponds to the portable transmitter, tuning said receiver in response to said digital signal, and determining the direction to the portable transmitter from said receiver.

20. The method of claim 19 wherein said plurality of antennas are Doppler antennas.

21. The method of claim 19 wherein said plurality of antennas are at least three in number and are configured such that one of each of said plurality of antennas is located on the vertex of an equilateral triangle.

22. The method of claim 19 wherein said step of switching between said antennas is achieved with an analog waveform.

23. The method of claim 22 wherein said analog waveform is Gaussian shaped.

24. The method of claim 19 wherein said step of identifying whether said digital signal corresponds to the portable transmitter is achieved with a coherent AM detector.

25. The method of claim 19 wherein said step of processing said digital signal includes the step of summing the output of said coherent AM detector with a received signal strength indicator signal to extend the dynamic range of said receiver.

26. The method of claim 25 wherein said step of processing said digital signal does not include the use of automatic gain control during normal operation.

* * * * *